US009701320B2

(12) United States Patent
Chedal Bornu

(10) Patent No.: US 9,701,320 B2
(45) Date of Patent: Jul. 11, 2017

(54) MECHANICAL LIFT SEAT AND INSTALLATION EQUIPPED WITH THIS SEAT

(71) Applicant: SOMMITAL, Chambery (FR)

(72) Inventor: Yves Chedal Bornu, Bozel (FR)

(73) Assignee: SOMMITAL, Chambery (FR)

( * ) Notice: Subject to any disclaimer, the term of this patent is extended or adjusted under 35 U.S.C. 154(b) by 140 days.

(21) Appl. No.: 14/408,449

(22) PCT Filed: Jun. 13, 2013

(86) PCT No.: PCT/FR2013/051381

§ 371 (c)(1),
(2) Date: Dec. 16, 2014

(87) PCT Pub. No.: WO2013/190220

PCT Pub. Date: Dec. 27, 2013

(65) Prior Publication Data

US 2015/0197256 A1 Jul. 16, 2015

(30) Foreign Application Priority Data

Jun. 20, 2012 (FR) ..... 12 55787

(51) Int. Cl.

| | |
|---|---|
| ***B61B 12/06*** | (2006.01) |
| ***B61B 12/00*** | (2006.01) |
| ***E05B 47/00*** | (2006.01) |

(52) U.S. Cl.

CPC ..... *B61B 12/06* (2013.01); *B61B 12/002* (2013.01); *E05B 47/0002* (2013.01)

(58) Field of Classification Search

CPC .. B61B 3/00; B61B 9/00; B61B 11/00; B61B 12/00; B61B 12/02; B61B 12/002; B61B 12/028; B61B 12/04; B61B 12/06

See application file for complete search history.

(56) References Cited

U.S. PATENT DOCUMENTS

| | | | |
|---|---|---|---|
| 4,275,921 | A | 6/1981 | Genin |
| 5,876,504 | A | 3/1999 | Fuji et al. |

(Continued)

FOREIGN PATENT DOCUMENTS

| | | | |
|---|---|---|---|
| CH | 265702 | A | 12/1949 |
| EP | 2030858 | A2 | 3/2009 |

(Continued)

OTHER PUBLICATIONS

Jul. 29, 2013 International Search Report issued in Application No. PCT/FR2013/051381.

(Continued)

*Primary Examiner* — R. J. McCarry, Jr.
(74) *Attorney, Agent, or Firm* — Oliff PLC

(57) ABSTRACT

This seat includes a guard-rail able to occupy a lowered first extreme position and a raised second extreme position, and means for locking the guard rail when it is in a lowered position. The locking means include a bistable electromagnet provided with a rod that is able to move between a stable first position in which the rod allows the guard rail to lock in the lowered position by interposing an obstacle in the upward path described by a guard rail element to pass from the lowered position to the raised position, and a stable second position in which the rod allows the guard rail to unlock so that it can be moved into the raised position by moving the obstacle away from the upward path described by the guard rail element.

10 Claims, 4 Drawing Sheets

(56) References Cited

U.S. PATENT DOCUMENTS

Figure 1:
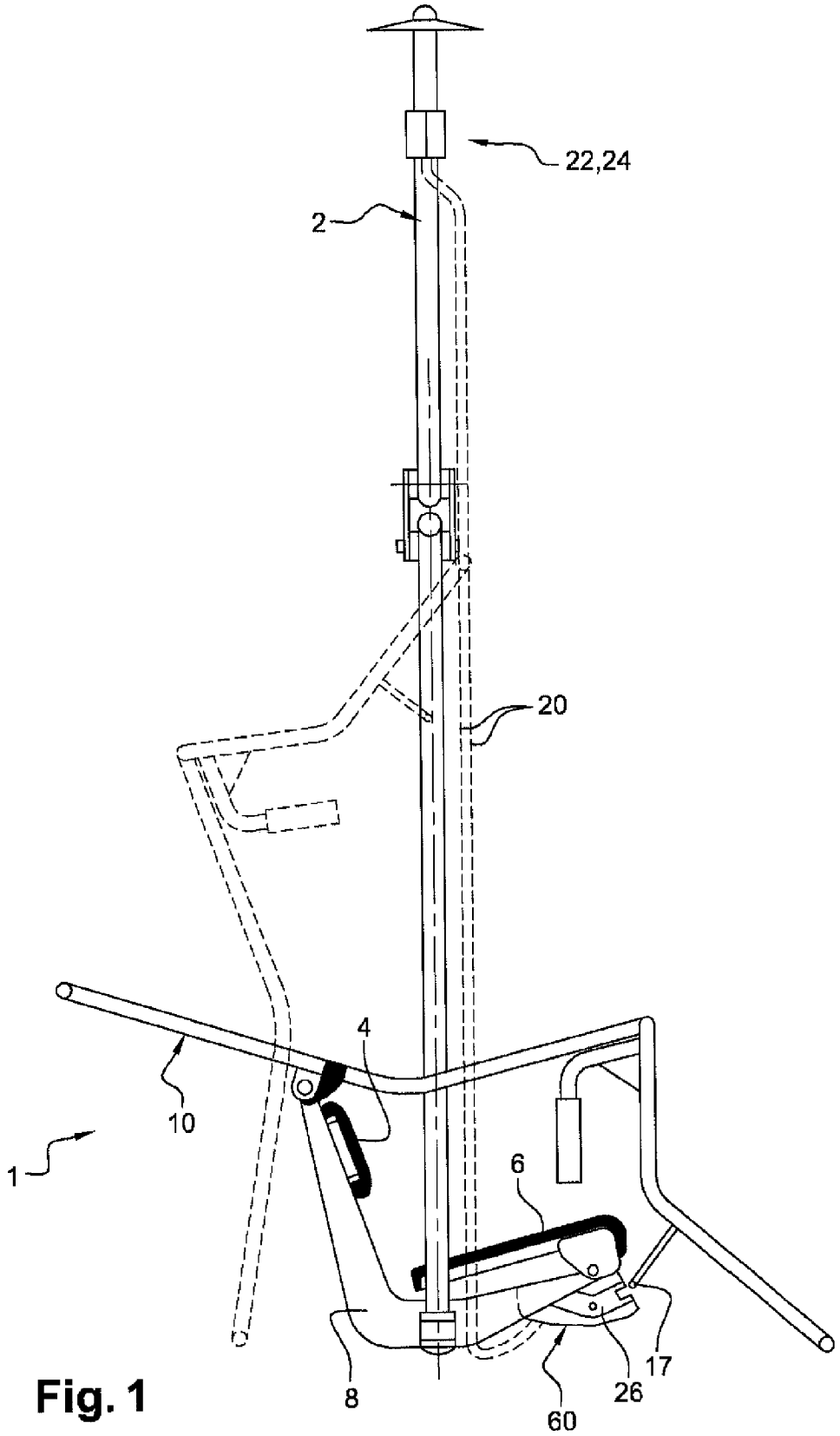

| | | | | |
|---|---|---|---|---|
| 2009/0058170 | A1* | 3/2009 | Switzeny | B61B 12/002 297/487 |
| 2009/0243366 | A1* | 10/2009 | Blandon | B61B 12/06 297/464 |
| 2011/0259235 | A1 | 10/2011 | Blandon et al. | |
| 2011/0277660 | A1 | 11/2011 | Tamisier et al. | |

FOREIGN PATENT DOCUMENTS

| | | | |
|---|---|---|---|
| FR | 2950847 | A3 | 4/2011 |
| JP | 2009-057040 | A | 3/2009 |
| JP | 2009-537398 | A | 10/2009 |
| JP | 2012-507446 | A | 3/2012 |
| RU | 2401216 | C2 | 10/2010 |
| WO | 2007/135256 | A1 | 11/2007 |
| WO | 2010/052426 | A2 | 5/2010 |

OTHER PUBLICATIONS

Mar. 7, 2017 Office Action issued in Japanese Application No. 2015-517824.

* cited by examiner

MECHANICAL LIFT SEAT AND INSTALLATION EQUIPPED WITH THIS SEAT

The present invention relates to a mechanical lift seat and a mechanical lift installation equipped with this seat.

Traditionally, a mechanical lift installation allows passengers, skiers or pedestrians, to climb or descend slopes. A mechanical lift installation generally includes two end stations, one station placed at the bottom of the slope and one station placed at the top of the slope. These end stations are connected by an aerial carrying and hauling cable that may form a closed loop. It is known to drive the cable thanks to pulleys and to support it by means of pylons. Vehicles hanged by the cable allow conveying passengers from one end station to another.

Conveying passengers to the top or to the bottom of a slope requires complying with a high safety level, because the seats generally circulate at a relatively significant distance from the ground. It is thus known from patent document WO2007/135256 to improve the safety of passengers via a magnetic member cooperating with an element made of a ferromagnetic material carried by one passenger.

It is also known to improve the safety of passengers by the use of a guard rail limiting the risks of a passenger to accidentally fall from the seat.

The guard rails are conventionally pivotally mounted relative to the seat in order to allow the embarkation and the disembarkation of the passengers. We distinguish a lowered position of use and a raised position of use of the guard rail. When the guard rail is in the lowered position, it constitutes an obstacle to the tilting of a passenger into the void. This lowered position of the guard rail is normally adopted during a travel phase of the seat out of the embarkation and disembarkation areas. When the guard rail is in a raised position, it frees the space at the front of the seat so as to allow passengers to sit on the seat or to leave it. The guard rail is thus normally in the raised position when the seat is located in an embarkation or disembarkation area.

For safety reasons, the guard rail should not be raised during all the travel phase out of the embarkation and disembarkation areas. However, the existing seats generally offer only but a limited safety, to the extent that nothing prevents the passengers from raising the guard rail during the travel of the seat out of the embarkation and disembarkation areas.

To remedy this, it is known to use devices for mechanically blocking the guard rail, as the one disclosed in patent document EP2030858. However, these mechanical devices impose a structure which is often complex. Hence, these devices offer only but the possibility to be capable of being mounted on vehicles under construction. They do not adapt to the vehicles of the existing mechanical installations and require in addition a quite significant maintenance. Finally, although they improve the safety of passengers, the known devices weigh down the vehicles, thus causing an early wear of the vehicles of the mechanical lift installations.

Thus, the present invention aims to solve all or part of the drawbacks mentioned above by providing a mechanical lift seat offering an increased safety for the passengers by preventing the rise of the guard rail during the transit phases of the seat between two end stations, while being adaptable to existing mechanical lift installations, light, and easy to maintain.

To this end, the present invention has for an object a mechanical lift seat comprising a guard rail capable of occupying a first lowered extreme position delimiting an enclosed space allowing to prevent a passenger from falling and a second raised extreme position in which the guard rail frees a space at the front of the seat to allow the disembarkation of one or several passenger(s), and means for locking the guard rail when the latter occupies a lowered position, characterized in that the locking means comprise a bistable electromagnet provided with a rod movable between a first steady position in which the rod allows locking of the guard rail in the lowered position by interposing an obstacle on the upward trajectory described by a guard rail element to pass from the lowered position to the raised position, and a second steady position in which the rod allows unlocking of the guard rail in order to displace it up to the raised position by displacement of the obstacle away from the upward trajectory described by the guard rail element.

Thus, the seat according to the invention offers the possibility to lock the guard rail in the lowered position, thus contributing to increase the safety of passengers, with a system with a lesser complexity than the pre-existing systems, furthermore requiring little maintenance, and capable of being easily installed on pre-existing seats without, however, excessively weighing them down.

In addition, the use of a bistable electromagnet with a movable rod makes the seat less sensitive to weather conditions to which it is exposed, often hostile to the extent that the seats are used in the mountains, and quite often in wintertime. In particular, the guard rail locking system of the seat according to the invention exhibits a lesser sensitivity to frost which tends to form on the metallic elements of seats, and which may disrupt the operation of traditional guard rail locking systems.

According to one embodiment, the obstacle is formed by a rocker movable in rotation relative to the seat between a locking position in which a first operational surface of a first end of the rocker is arranged across the upward trajectory described by the guard rail element, and an unlocking position in which the first operational surface is arranged away from the upward trajectory described by the guard rail element, the displacement of the rod of the bistable electromagnet from the second steady position to the first steady position allowing immobilizing the rocker in the locking position and, reciprocally, the displacement of the rod from the first steady position to the second steady position allowing enabling the rotation of the rocker to the unlocking position.

Advantageously, the locking means also comprise a blocking member movable relative to the seat and fastened to the rod of the electromagnet, the displacement of the rod consequently causing a displacement of the blocking member between a blocking position of the rocker, in which the blocking member is capable of blocking the rocker in the locking position, and a release position, in which the blocking member enables the rotation of the rocker from the locking position to the unlocking position.

The blocking member is, for example, movable in rotation.

The blocking member may comprise an end intended to come on the trajectory of an abutment member of a second end of the rocker.

The blocking member is for example substantially rectilinear, and the rotation axis of the blocking member may be arranged substantially on a tangent to the circle described by the abutment member of the second end when the rocker pivots relative to the seat.

The tangent may correspond to the tangent at a point M of the abutment member when the rocker is in the locking position.

Advantageously, the first end of the rocker comprises a second operational surface arranged on the trajectory described by the guard rail element when the guard rail is displaced from the raised position to the lowered position to cause, when the guard rail element bears against the second operational surface, the rotation of the rocker from the unlocking position to the locking position.

The second operational surface may be arranged facing the first operational surface so that the first operational surface and the second operational surface delimit a housing therebetween for receiving the guard rail element.

According to one possibility, the seat comprises position return means arranged for returning the rocker in the unlocking position.

The return means may comprise a torsion spring.

The torsion spring comprises for example a first end bearing against a spur fastened to the seat and a second end attached to the rocker.

The second end may be inserted in a housing arranged on the rocker.

According to one embodiment, the seat comprises embedded electrical conductors arranged to be connected to a power supply circuit equipping a mechanical lift installation, the embedded electrical conductors being electrically connected to the bistable electromagnet.

According to one embodiment, the rod of the electromagnet is movable in translation between the first steady position and the second steady position.

According to an alternative embodiment, the rod of the electromagnet is movable in rotation between the first steady position and the second steady position.

Advantageously, the electromagnet is provided with two abutments arranged to stop the rotation of the blocking member when the blocking member displaced by the rod reaches the blocking position and the release position.

The locking means may be arranged under the seat. For example, the seat comprises a flange extending under the seat and supporting the electromagnet and/or the blocking member and/or the rocker.

The guard rail element may correspond to a spur integral with a foot step of the guard rail.

The rod of the electromagnet is alternately movable between the first steady position and the second steady position for example under the effect of electrical pulses with an alternating polarity which may be triggered during the passage of the seat at the entrance of a disembarkation area of an end station and/or an embarkation area of an end station.

According to one embodiment, the electromagnet comprises a first coil and a second coil intended to be alternately fed to displace the rod in an alternating manner between the first position and the second position.

The invention also relates to a mechanical lift installation comprising at least one mechanical lift seat having the aforementioned characteristics.

Figure 2:
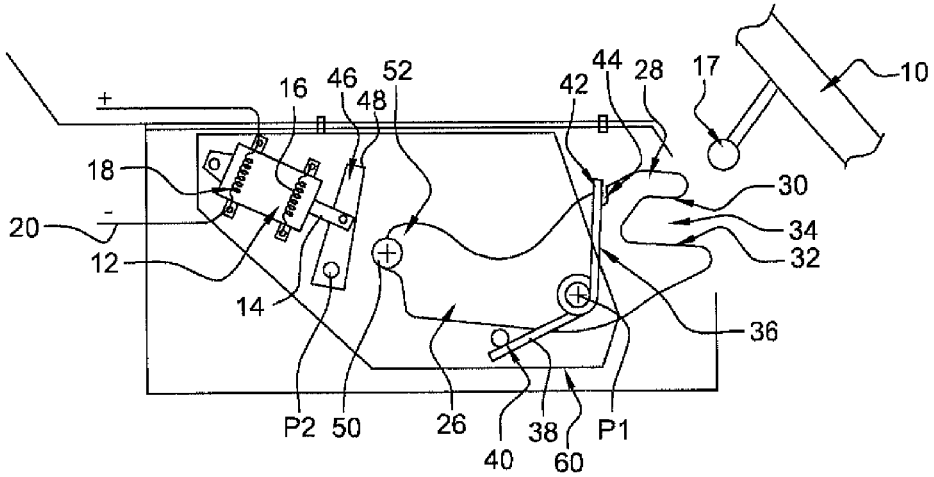
Figure 3:
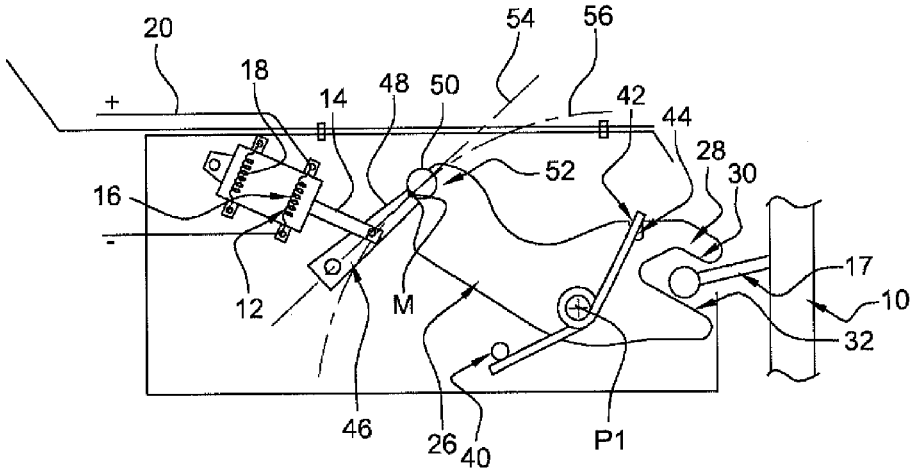
Figure 4:
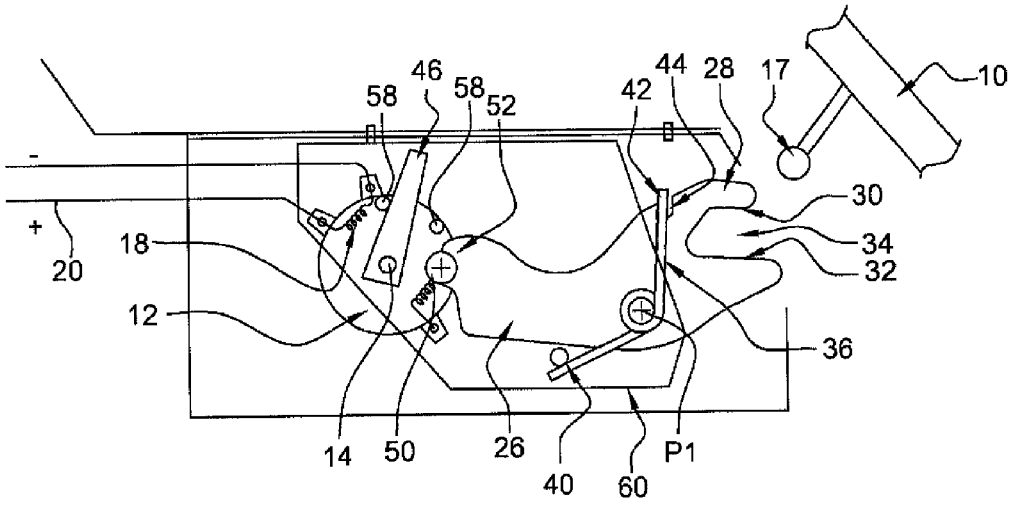
Figure 5:
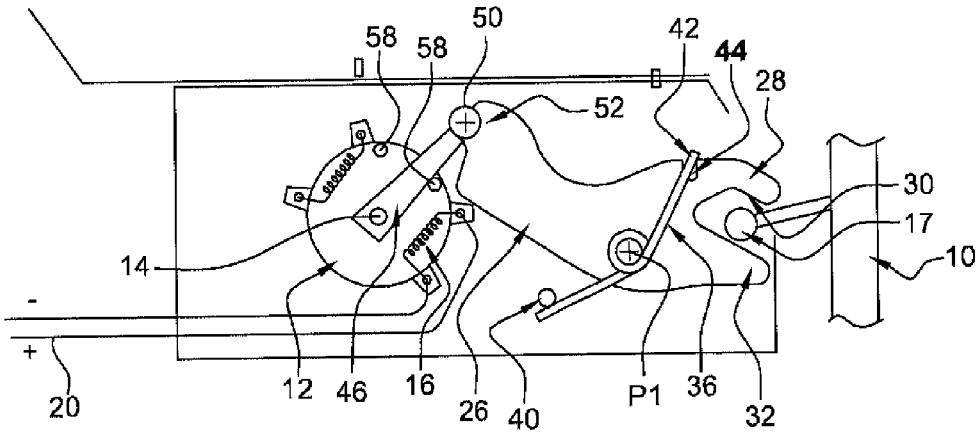
Figure 6:
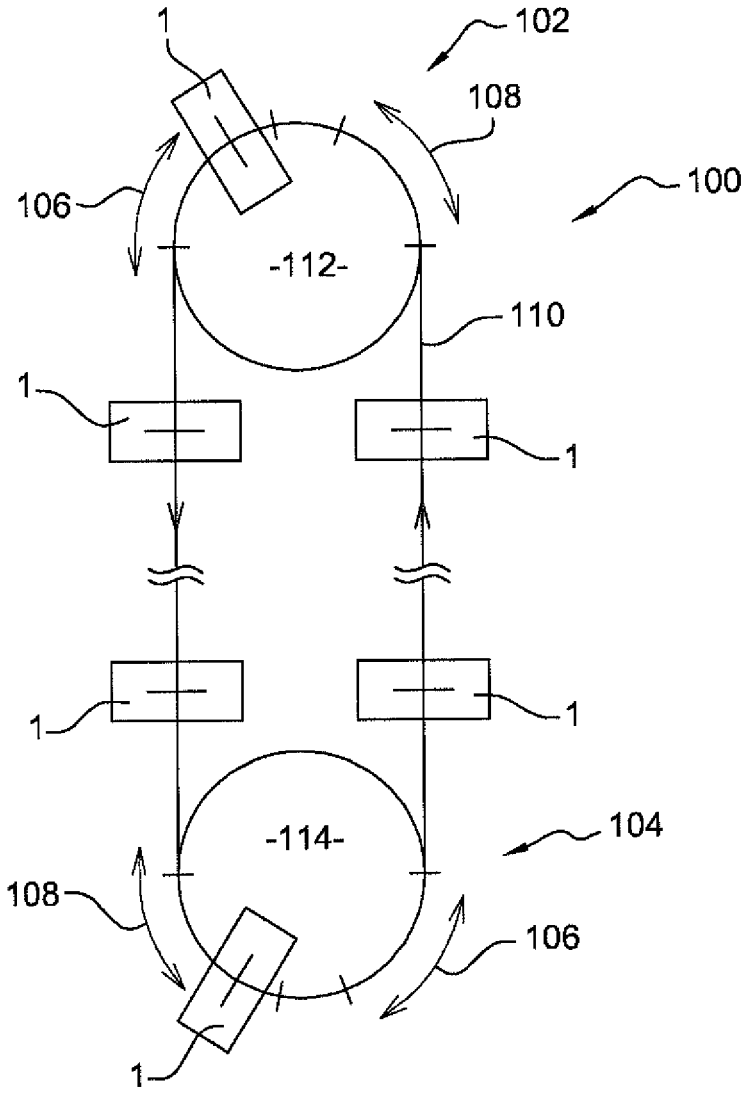

Other characteristics and advantages will become apparent from the description below of an embodiment, given by way of non-limiting example, with reference to the appended drawings in which:

FIG. 1 is a schematic side view of a mechanical lift seat according to one embodiment of the invention, FIGS. 2 and 3 are schematic side views of a portion of a mechanical lift seat according to one embodiment of the invention, in several operating positions, FIGS. 4 and 5 are schematic side views of a portion of a mechanical lift seat according to another embodiment of the invention, in several operating positions, FIG. 6 is a schematic top view of a mechanical lift installation according to one embodiment of the invention.

FIG. 1 shows a mechanical lift seat 1 according to one embodiment of the invention, while FIG. 6 shows a mechanical lift installation 100, for example of the chairlift type, equipped with at least one seat 1 according to one embodiment of the invention.

According to the example of FIG. 6, the mechanical lift installation 100 comprises two end stations 102, 104. Each end station 102, 104 may include a passengers' embarkation area 106 and a passengers' disembarkation area 108. Each mechanical lift seat 1 is intended to be hanged by an aerial hauling cable 110, carried by pylons, via a hanger 2. The cable 110 here forms a closed loop and may be driven by pulleys 112, 114.

As it is visible on Figure 1, the seat 1 may conventionally include a backrest 4 and a seating 6 for supporting one or several passenger(s). The backrest 4 and the seating 6 are here fastened to a frame 8 to which the hanger 2 is also fastened.

The mechanical lift seat 1 comprises a guard rail 10 capable of occupying a first lowered extreme position, visible in solid lines on FIG. 1, delimiting an enclosed space allowing to prevent a passenger from falling and a second raised extreme position, represented in dashed lines on FIG. 1, in which the guard rail 10 frees a space at the front of the seat 1 to allow the disembarkation of one or several passenger(s).

The mechanical lift seat 1 also comprises means for locking the guard rail 10 when the latter occupies a lowered position.

According to the invention, the locking mechanism comprises a bistable electromagnet 12, provided with a rod 14, visible on FIGS. 2 to 5.

The rod 14 is movable between a first steady position, represented in FIGS. 3 and 5, in which the rod 14 allows locking the guard rail 10 in the lowered position, and a second steady position in which the rod 14 allows unlocking of the guard rail 10 in order to displace the guard rail 10 up to the raised position.

According to the embodiment illustrated in FIGS. 2 and 3, the rod 14 is movable in translation relative to the electromagnet 12, between two steady positions corresponding to the first position and to the second position.

According to the embodiment illustrated in FIGS. 4 and 5, the rod 14 is movable in rotation relative to the electromagnet 12, between two steady positions corresponding to the first position and to the second position.

Whatever the motion of the rod 14 is (translation or rotation), it is alternately movable between the first steady position and the second steady position.

The electromagnet 12 comprises for example a first coil 16 and a second coil 18, each electrically connected, for example via a wire link 20, to two electrical conductors 22, 24 embedded on the seat 1, in particular on the hanger 2, as those described in patent document WO 2010/052426. The electrical conductors 22, 24 are intended to cooperate for example with a system of conductive brushes as the one described in patent document WO 2010/052426, located at the end stations 102, 104, for feeding the electromagnet 12.

If an electrical pulse is given to the first coil 16, there will follow for example the displacement of the rod 14 from the second position to the first position ("exit" of the rod 14 for a rod 14 movable in translation, and "rotation to the right" for a rod 14 movable in rotation). As long as no electrical pulse is given to the second coil 18, this state remains. It is not necessary to keep the first coil 16 fed with electricity so that the rod 14 stays in the first position. When an electrical pulse is applied to the second coil 18, the state of the bistable electromagnet 12 changes: the rod 14 moves from the first position to the second position (it "enters" for an electromagnet 12 to a rod 14 movable in translation, it pivots to the left, relative to the viewpoint of FIGS. 4 and 5, for an electromagnet 12 with a rod 14 movable in rotation).

Thus, when an electrical pulse is given to the bistable electromagnet 12, the state of this bistable electromagnet 12, that is to say the position of the rod 14, is changed depending on whether we feed the first coil 16 or the second coil 18.

The locking of the guard rail 10 is performed by interposing an obstacle on the upward trajectory described by a guard rail element 17, such as a spur integral with a foot step of the guard rail 10, to pass from the lowered position to the raised position, while the unlocking of the guard rail 10 is performed by displacement of this obstacle away from the upward trajectory described by the guard rail element 17.

The obstacle is here formed by a rocker 26, movable in rotation relative to the seat 1 about a pivot link P1, between a locking position, illustrated in FIGS. 3 and 5, and an unlocking position, illustrated in FIGS. 2 and 4.

The rocker 26 comprises in particular a first end 28, provided with a first operational surface 30. In the locking position, the first operational surface 30 is arranged across the upward trajectory described by the guard rail element 16, as it is visible on FIG. 3 or FIG. 5. In the unlocking position, the first operational surface 30 is arranged away from the upward trajectory described by the guard rail element 16, as it is illustrated in FIGS. 2 and 4.

The first end 28 of the rocker 26 may also comprise a second operational surface 32 arranged on the upward trajectory described by the guard rail element 16 when the guard rail 10 is displaced from the raised position to the lowered position.

Thus, when the guard rail 10 is displaced to the lowered position, the guard rail element 16 bears against the second operational surface 32, thus causing the rotation of the rocker 26 from the unlocking position to the locking position.

The second operational surface 32 is for example arranged facing the first operational surface 30 so that the first operational surface 30 and the second operational surface 32 delimit a housing 34 therebetween for receiving the guard rail element 16.

Position return means, such as a torsion spring 36, may be provided to return the rocker 26 in the unlocking position. The torsion spring 36 comprises for example a first end 38 bearing against a spur 40 integral with the seat 1 and a second end 42 fastened to the rocker 26. The second end 42 may be inserted in a housing 44 arranged on the rocker 26. Thus, the rocker 26 exhibits a steady equilibrium position corresponding to the unlocking position.

It will be noted that the displacement of the rod 14 from the second position to the first position allows immobilizing the rocker 26 in the locking position, whereas the reverse displacement of the rod 14, that is to say its displacement from the first position to the second position, allows enabling the rotation of the rocker 26 until the latter reaches the unlocking position.

To do so, the seat 1 may comprise a blocking member 46. The blocking member 46 is movable relative to the seat 1, for example by rotating about a pivot link P2, between a blocking position, visible on FIGS. 3 and 5, and a release position, visible on FIGS. 2 and 4. In the blocking position, the blocking member 46 allows blocking the rocker 26 in the locking position. In the release position, the blocking member 46 enables the rotation of the rocker 26 so that the latter leaves the locking position.

The blocking member 46 is here fastened to the rod 14 of the electromagnet 12, so that the displacement of the rod 14 causes the simultaneous displacement of the blocking member 46.

In addition, when the rod 14 is in the first position, the blocking member 46 is in the blocking position, whereas when the rod 14 is in the second position, the blocking member 46 is in the release position.

Thus, the displacement of the rod 14 from the first position to the second position causes the displacement of the blocking member 46 from the blocking position to the release position, and vice versa.

As it is visible on FIGS. 2 to 5, the blocking member 46 may comprise an end 48 intended to hinder the trajectory described by an abutment member 50 when the rocker 26 is displaced to the unlocking position. Here, the abutment member 50 is fastened to a second end 52 of the rocker 26, the second end 52 being arranged opposite to the first end 28.

Advantageously, the blocking member 46 may be substantially rectilinear, and its rotation axis relative to the seat 1 may be arranged substantially on or in the vicinity of a tangent 54 at a point M to the circle 56 described by the abutment member 50 when the rocker 26 pivots relative to the seat 1, the point M corresponding to a point of this abutment member 50 when the rocker 26 is in the locking position.

It will be remarked that, according to the embodiment illustrated in FIGS. 4 and 5, the electromagnet 12 may comprise two abutments 58 arranged to stop the rotation of the blocking member 46 when the latter, displaced by the rod 14, reaches the blocking position and the release position.

The operation of the seat 1 according to the embodiment of FIGS. 2 and 3 is described below, starting from an initial situation in which the rod 14 is in the second position, the blocking member 32 in the release position, and the rocker 26 in the unlocking position (FIG. 2).

In this situation, the locking system of the guard rail 10 is disarmed; the guard rail 10 may be freely displaced between the raised position and the lowered position.

When the seat 1 reaches the inlet of an embarkation area 106, the electromagnet 12 is fed with electricity via the electrical conductors 22, 24, so that the rod 14 is displaced to the first steady position, thus causing the displacement of the blocking member 46 to the release position. More precisely, an electrical pulse is applied to the electrical poles of the first coil 16. In this situation, the locking system of the guard rail 10 is armed.

When the passenger(s) lower(s) the guard rail 10 to the lowered position, for example at the exit of the embarkation area 106, the guard rail element 17 bears against the second operational surface 32, and drives the rocker 26 in a rotational motion to the locking position of the rocker 26.

During this rotational motion, the second end 52 of the rocker 26 presses against the blocking member 46 by slightly pushing it before positioning just above the end 48 of the blocking member 46, the latter being pushed by the rod 14 held by tending to hold itself in the first steady position. The blocking member 46 hence acts like a non-return ratchet. Simultaneously, the first operational surface 30 is positioned behind the guard rail element 17, which it entraps in the housing 34, by hindering the return trajectory of the guard rail element 17.

The rocker 26 is then immobilized in the blocking position. The guard rail 10 is in turn locked in the lowered position.

When the seat 1 reaches a disembarkation area 108, the electromagnet 12 is electrically fed via the electrical conductors 22, 24, thus causing the displacement of the rod 14 from the first position to the second steady position, and consequently the displacement of the blocking member 46 to the release position. More precisely, when the seat 1 reaches a disembarkation area 108, the second coil 18 is fed with electricity to displace the rod 14 in the second position and thus disarm the locking of the guard rail 10.

The rocker 26 is hence no longer immobilized; it tends to reposition in the unlocking position under the action of the spring 36. Furthermore, the rise of the guard rail 10 by one or several passenger(s) causes, where appropriate, the pressing of the guard rail element 17 against the first operational surface 30, thus contributing to the rotation of the rocker 26 to the unlocking position.

The guard rail element 17 being no longer entrapped in the housing 34, the guard rail 10 may be displaced up to the raised position to allow passengers getting out of the seat 1.

When the seat 1 then reaches the inlet of an embarkation area 106, a new cycle may start, the feeding of the electromagnet 12 with an again reversed polarity allowing rearming the locking system of the guard rail 10.

The operation of the seat 1 according to the embodiment of FIGS. 4 and 5 is analog to that described with reference to FIGS. 2 and 3, with the difference that the rod 14 is displaced in rotation between the first position and the second position, and that the displacement of the blocking member 32 may be stopped by the abutments 58 so that the blocking member 32 stops in the blocking or release position (depending on the abutment 58 against which it bears).

Of course, the invention is in no way limited to the embodiment described above, this embodiment having been given only as an example. Modifications remain possible, in particular from the point of view of the constitution of the various elements or by the substitution of technical equivalents, without thereby departing from the protection scope of the invention.

Thus, instead of a torsion spring 36, it may be considered to use a tension or compression spring.

It will be noted that the locking means, in particular the electromagnet 12, the rocker 26, and the blocking member 46 are here arranged under the seat 1, and fastened for example to a flange 60 extending under the seat 1, but they might be fastened to any other portion of the seat 1, in other words elsewhere than under the seat 1.

The invention claimed is:

1. A mechanical lift seat comprising a guard rail capable of occupying a first lowered extreme position delimiting an enclosed space allowing to prevent a passenger from falling and a second raised extreme position in which the guard rail frees a space at the front of the seat to allow the disembarkation of one or several passenger(s), and a locking mechanism configured to lock the guard rail when the latter occupies a lowered position, wherein the locking mechanism comprises a bistable electromagnet provided with a rod movable between a first steady position in which the rod allows locking of the guard rail in the lowered position by interposing an obstacle on the upward trajectory described by a guard rail element to pass from the lowered position to the raised position, and a second steady position in which the rod allows unlocking of the guard rail in order to displace it to the raised position by displacement of the obstacle away from the upward trajectory described by the guard rail element.

2. The mechanical lift seat according to claim 1, wherein the obstacle is formed by a rocker movable in rotation relative to the seat between a locking position in which a first operational surface of a first end of the rocker is arranged across the upward trajectory described by the guard rail element, and an unlocking position in which the first operational surface is arranged away from the upward trajectory described by the guard rail element, the displacement of the rod of the bistable electromagnet from the second steady position to the first steady position allowing immobilizing the rocker in the locking position and, reciprocally, the displacement of the rod from the first steady position to the second steady position allowing enabling the rotation of the rocker to the unlocking position.

3. The mechanical lift seat according to claim 2, wherein the locking mechanism also comprises a blocking member movable relative to the seat and fastened to the rod of the electromagnet, the displacement of the rod consequently causing a displacement of the blocking member between a blocking position of the rocker, in which the blocking member is capable of blocking the rocker in the locking position, and a release position, in which the blocking member enables the rotation of the rocker from the locking position to the unlocking position.

4. The mechanical lift seat according to claim 2, wherein the first end of the rocker comprises a second operational surface arranged on the trajectory described by the guard rail element when the guard rail is displaced from the raised position to the lowered position to cause, when the guard rail element bears against the second operational surface, the rotation of the rocker from the unlocking position to the locking position.

5. The mechanical lift seat according to claim 2, wherein the seat comprises a position return member arranged for returning the rocker in the unlocking position.

6. The mechanical lift seat according to claim 1, wherein the seat comprises embedded electrical conductors arranged to be connected to a power supply circuit equipping a mechanical lift installation, the embedded electrical conductors being electrically connected to the bistable electromagnet.

7. The mechanical lift seat according to claim 1, wherein the rod of the electromagnet is movable in translation between the first steady position and the second steady position.

8. The mechanical lift seat according to claim 1, wherein the rod of the electromagnet is movable in rotation between the first steady position and the second steady position.

9. The mechanical lift seat according to claim 1, wherein the electromagnet comprises a first coil and a second coil intended to be alternately fed to displace the rod in an alternating manner between the first position and the second position.

10. A mechanical lift installation comprising at least one mechanical lift seat according to claim 1.

* * * * *